United States Patent [19]

Bowditch

[11] 4,364,325

[45] Dec. 21, 1982

[54] PASSIVE CONTROLLED BUOYANCY APPARATUS

[75] Inventor: Philip N. Bowditch, Cohasset, Mass.

[73] Assignee: The Charles Stark Draper Laboratory, Inc., Cambridge, Mass.

[21] Appl. No.: 209,834

[22] Filed: Nov. 24, 1980

[51] Int. Cl.[3] ..... B63B 39/04; B63B 43/06

[52] U.S. Cl. ..... 114/331; 114/124; 114/125; 92/37; 441/29

[58] Field of Search ..... 102/406; 114/125, 124, 114/330, 331, 333; 9/8 R, 8.3 R, 8.3 E, 9; 441/28, 29; 92/34–37, 44–46, 39, 40, 43

[56] References Cited

U.S. PATENT DOCUMENTS

| | | | |
|---|---|---|---|
| 2,965,137 | 12/1960 | Leeson | 92/37 |
| 3,179,962 | 4/1965 | Shear et al. | 114/125 |
| 3,228,369 | 1/1966 | Warhurst et al. | 114/125 |
| 3,301,209 | 1/1967 | Caldwell, Jr. | 114/125 |
| 3,436,776 | 4/1969 | Davis | 114/125 |
| 3,480,907 | 11/1969 | King | 114/125 |
| 3,520,263 | 7/1970 | Berry et al. | 114/125 |
| 3,590,635 | 7/1971 | Duing | 114/125 |
| 3,601,827 | 8/1971 | Miller | 114/125 |
| 3,631,551 | 1/1972 | Miller | 114/125 |
| 3,753,311 | 8/1973 | Boone | 114/125 |
| 3,897,742 | 8/1975 | Hoffman | 114/125 |
| 4,031,581 | 6/1977 | Baugh | 114/125 |
| 4,096,598 | 6/1978 | Mason | 114/125 |
| 4,121,529 | 10/1978 | Smith et al. | 114/125 |
| 4,183,316 | 1/1980 | Bennett | 9/8 R |
| 4,286,539 | 9/1981 | Pignone | 114/124 |

*Primary Examiner*—Trygve M. Blix
*Assistant Examiner*—D. W. Keen
*Attorney, Agent, or Firm*—Kenway & Jenney

[57] ABSTRACT

A passive near neutral buoyancy platform includes a structure housing a series of gas-filled cells, restrained in their maximum volume regardless of the internal charge pressure, and collapsible in character when external pressure exceeds the charge pressure. With this structure, once a cell having a predetermined initial internal charge pressure reaches a depth where the external pressure exceeds this initial value, that cell contracts, resulting in a net buoyancy change for the structure. Where this series of cells is attached integrally to a single structure, the cells form a pre-loaded compressibility compensation device which is matched to the external environment.

9 Claims, 6 Drawing Figures

PASSIVE CONTROLLED BUOYANCY APPARATUS

BACKGROUND OF THE INVENTION

The field of the invention oceanographic instrumentation, and more particularly to the invention relates to devices for passively maintaining near-neutral bouyancy in a known density versus depth environment.

All materials, and in particular hollow structures formed from a given material, exhibit a volume compressibility (a). This volume compressibility, when multiplied by nominal volume (V) and a pressure (P) yields the differential volume ($\Delta V$) that the structure will exhibit when exposed to the pressure P. In order to maintain neutral buoyancy of the structure in a liquid medium, it is essential that the structure have an indentical characteristic ($\Delta V/P$) to the medium in which is to be submerged. However, in practice, it is difficult to match the $\Delta V/P$ characteristic of a structure to a real-world medium, such as the ocean. Generally, a compensation scheme must be employed in order to maintain essentially constant buoyancy for the structure over a predetermined range of depths.

In the oceans for example, there are water density versus depth profiles that vary significantly worldwide. In order to provide a structure, or device, that may be immersed in such a liquid medium, so that the structure maintains a desired buoyancy (either positive, neutral, or negative) regardless of depth of submersion, the specific water density versus depth profile must be exactly compensated for at the exact geographic location where the structure is to be submerged. There are prior art approaches to providing such compensation which require "active" mechanizations. While such approaches are effective in providing the desired compensation, the active nature of such mechanization generally requires an onboard power supply and, in some implementations, gas generating devices. The addition of such supplies and devices requires a corresponding expense, as well as provides reliability limitations on the structure.

It is an object of the present invention to provide a passive structure having a controlled bouyancy in a non-linear density versus depth medium environment.

SUMMARY OF THE INVENTION

Briefly, the present invention includes a hollow, submersible platform. The platform includes a base structure and a plurality of separate volumes, or cells, each of which is preset to an internal charge pressure ($P_C$) and has an associated maximum volume ($V_C$). Each of the volumes is compressible from its maximum volume. In one form of the invention, each cell is defined by an elastically collapsible metal bellows assembly which is sealed at each end with a pressure plate. The overall structure has a compressibility coefficient ($a_S$) less than the corresponding coefficient ($a_L$) of the liquid medium in which the platform is to be submerged. The charge pressures in the respective cells are determined in relation to the water column density versus depth profile at the point at which the structure is to be submerged.

In one form of the invention, the charge pressures in the cells are selected so that as the structure is submerged, the overall structure compressibility is initially mismatched, providing increasingly positive buoyancy until the charge pressure of the first cell is reached. At that point, the volume of that first cell starts to decrease as the structure is further submerged. As this occurs, the net buoyancy of the structure decreases to a neutral buoyancy. As the structure continues to be further submerged, its net buoyancy then proceeds negative to a maximum value equal to the positive value which existed at the charge pressure. As the device continues deeper, the net buoyancy begins to approach zero, cross zero, and finally go positive to a maximum equal to the original positive mismatch which occurred at the original pressure. The charge pressure of the second cell is selected so that, at this point, the pressure external to the structure equals the charge pressure of the second cell. As the structure continues to greater depths, the second cell begins to provide the compensation since the volume of the second cell decreases as the depth increases in a similar manner to the first cell. As this occurs, the net buoyancy of the structure proceeds to the negative peak value and then returns to the positive peak value.

The additional cells are similarly charged to predetermined pressures corresponding to successively greater depths so that this operation continues for as many cells as there are in the structure. By appropriate selection of the charge pressures nominal initial volumes of the various cells, any desired degree of compensation may be attained for the given density various depth profile of the medium.

In the prior art, buoyancy control has been accomplished by mechanical devices e.g. spring bellows and active servos. However, relatively high weight, size and complexity (in the case of servos) are inherent in these approaches. The passive buoyancy control approach of the prior art using high compressibility (two to four times that of water) requiring relatively large volumes and significant weight and bulk. In contrast, the gas-filled volumes required to accomplish passive buoyancy control in accordance with this invention are typically on the order of three precent of the total structure volume, and require relatively little weight.

Thus, the present invention includes a structure housing a series of gas-filled cells, restrained in their maximum volume regardless of the internal charge pressure, but collapsible in character when external pressure exceeds the charge pressure. With this structure, once a cell having a predetermined initial internal charge pressure reaches a depth where the external pressure exceeds this initial value, that cell contracts, resulting in a net buoyancy change for the structure. Where this series of cells is attached integrally to a single structure, the cells form a pre-loaded compressibility compensation device which is matched to the external environment.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
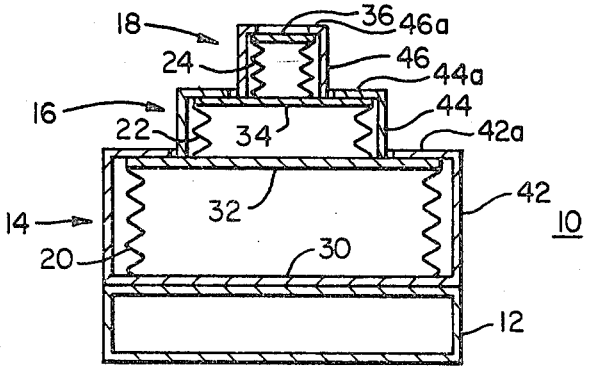
FIG. 1 shows an exemplary embodiment of the present invention.

FIG. 1 shows a passive near-neutral buoyancy platform which is adapted for submersion in a liquid medium in accordance with the present invention. Platform 10 includes a hollow, substantially incompressible base portion 12, and three variable volume hollow compensation cells 14, 16 and 18 coupled thereto. Each of cells 14, 16 and 18 (referred to below as cell 1, cell 2 and cell 3, respectively) includes an elastically collapsible bellows assembly (denoted by reference numerals 20, 22 and 24, respectively, in FIG. 1) which is sealed at each end with a pressure plate (pressure plates 30 and 32 for cell 1, pressure plates 32 and 34 for cell 2, and pressure plates 34 and 36 for cell 18). In addition, each of cells 1, 2 and 3 includes a volume limiter for limiting the maximum volume enclosed by the bellows assemblies of the respective cells to predetermined values. For cell 1, this volume limiter is established by the pressure plate 30, and lip member 42, which extends from plate 30, and includes an upper lip portion 42*a* which limits the motion of the pressure plate 32. Similarly, the volume limiter for cell 2 includes the pressure plate 32 and the lip member 44 having an upper lip portion 44*a*, and the volume limiter for cell 3 includes the pressure plate 34, and the lip member 46 including an upper lip portion 46*a*.

Each of cells 1, 2 and 3 includes a charge of gas within the interior of its associated bellows assembly at pressures $P_{C1}$, $P_{C2}$, and $P_{C3}$, respectively. The internal charge pressures for cells 1, 2 and 3 are successively increasing for those cells, such that $P_{C1}$ is less than $P_{C2}$, which in turn is less than $P_{C3}$. The maximum volume for the composite platform 10 is the volume of the base member 12, plus the sum of the maximum volumes established by pressure plates 32, 34 and 36 with the bellows assemblies fully extended to the lip portions of their associated volume limiters.

With this configuration, as the pressure external to the platform 10 increases, starting initially at a pressure below $P_{C1}$, all of the cells 1 through 3 are substantially incompressible. After the exterior pressure reaches a value corresponding to $P_{C1}$, the volume of cell 14 monotonically decreases as the pressure exterior to the platform increases. As the pressure exterior to platform 10 reaches $P_{C2}$, and continues to increase, the volume of cell 2 begins to monotonically decreases in a similar manner. Similarly, as the pressure external to platform 10 increases beyond $P_{C3}$, the volume of cell 3 begins to monotonically decrease.

Generally, the maximum volume for each cell is selected so that the density difference between the platform 10 and the liquid medium for that cell equals predetermined negative maximum values ($\Delta\rho_{max-}$) when the pressure in the liquid external to platform 10 equals the charge pressure for both that cell and the next successive cell. That density difference equals a predetermined positive value ($\Delta\rho_{max+}$) at the pressure (between the charge pressure for that cell and the next cell) where the rates of change of density with respect to pressure of the platform and the liquid medium are equal at pressures.

Figure 2:
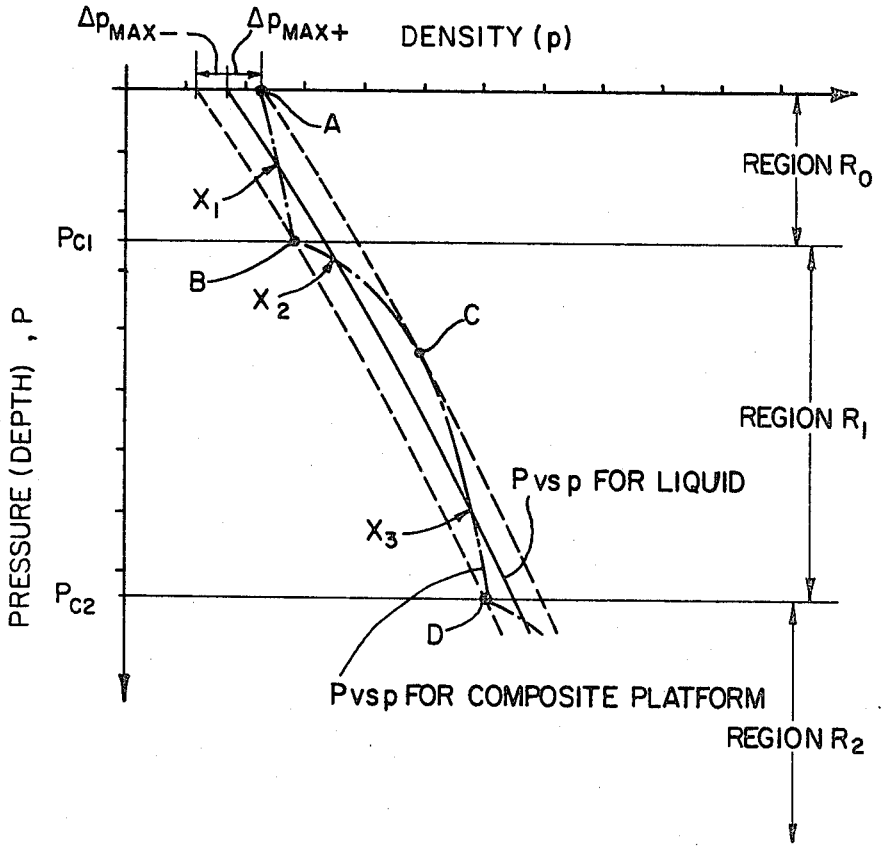
FIG. 2 illustrates the density versus pressure characteristics of the embodiment of FIG. 1.

In FIG. 2 the dash-dot broken line shows the density as a function of pressure (which corresponds to depth) for the exemplary platform of FIG. 1. In that figure, the solid line represents the pressure versus density function for the liquid medium while the dashed lines represent tolerance values $\Delta\rho_{max-}$ and $\Delta\rho_{max+}$ which are equidistant from the liquid pressure versus density curve in this particular example. In other examples, these tolerance values may be differing functions of pressure, however, the liquid medium may have a substantially nonlinear P versus density profile.

With this configuration, as shown in FIG. 2, during increasingly deep submersion of the platform 10 at depths, starting at point A (having a pressure lower than $P_{C1}$), the compressibility of the platform 10 is initially in mismatched, with a net positive buoyancy force on the platform 10. As the platform goes deeper, this buoyancy force becomes zero (at point $X_1$) and then becomes increasingly negative until the platform reaches point B. This region of operation, where all the cells are substantially incompressible, is denoted region $R_o$. As the platform 10 is further submerged, the pressure increases from $P_{C1}$, and the density of the platform increases relative to that of the liquid, so that the net negative buoyancy force on platform 10 decreases, passing through zero at point $X_2$, and becoming increasingly positive until platform 10 reaches its maximum positive density difference tolerance at point C, where the rates of change of density with pressure of platform 10 and the liquid are equal. Thereafter, with increasing pressure, the density of the platform passes through another neutral buoyancy point $X_3$ before reaching to point D at its maximum negative density tolerance at point D. This operation occurs in region $R_2$. Operation continues in a similar manner in regions $R_2$ and $R_3$ where cells 2 and 3 respectively first become compressible.

In FIG. 2, exact density versus depth match of the base member 12 plus volume compensation cells 1 through 3 to the liquid media is realized only at points $X_1$, $X_2$ and $X_3$, but the mismatch over the entire depth stays within a specified tolerance band, defined by the broken lines. At points $X_1$ and $X_3$, the platform 10 exhibits vertical positional stability, in that any motion of the object up and down at those specific depths is opposed by a density difference. At point $X_2$, the platform 10 is unstable and will migrate if left to its own choice to either point 1 or 3 depending on whether it were to start up or down.

Thus, the presently-described embodiment provides a series of gas-filled bellows-like volumes which are restrained in their maximum volume, regardless of the internal charge pressure, but are collapsible when the external pressure exceeds this charge pressure. Once the volume containing those predetermined internal pressure charges reach corresponding depth where the external pressures exceed those values, volume contraction occurs in accordance with Boyle's Law. Since these volume compensation cells are attached integrally to the platform base 12, they provide a pre-loaded compressibility compensation which is additive to the structural compressibility characteristics of the base member 12 at such depth where the internal pressure is exceeded by the pressure of the external environment. Since the density of the platform 10 is defined as the ratio of total mass to displaced volume, the inclusion of the compensation cells without predetermined maximum volumes and internal charge pressures matched to the density profile of the external medium as well as desired tolerance limits, permit an overall density mismatch which may be arbitrarily compensated to any desired precision by configuring platform 10 with a suitable number of appropriately chosen volume and charge pressure compensation cells.

In accordance with the invention, a composite platform including a fixed volume base structure and a plurality variable (pressure dependent) volume, precharged compensation cells (cell 1, cell 2, . . . , cell n) may be controlled to be neutrally buoyant within a predetermined tolerance. By way of example, the following analysis specifies the maximum volumes and internal pressure charger for a composite platform having fixed volume base structure (having a compressibility coefficient $a_S$) and a plurality of compensation cells (where the base structure and plurality of cells have a maximum composite volume $V_o$). The composite platform is adapted for immersion in a liquid having a linear density versus pressure (or depth) profile and having a compressibility coefficient $a_L$, which is greater than $a_S$. In this example, positive and negative peak variations in density of the platform from the density of the liquid are denoted $\Delta\rho_{max+}$ and $\Delta\rho_{max-}$, respectively, as shown in FIG. 2. For other density versus pressure profiles, the internal pressure charges for the cells and maximum cell volumes may be similarly determined, for example, using piece-wise linear approximations for the profile.

Generally, the cells 1 through n have increasing charge pressures denoted $P_{C1}$ through $P_{Cn}$, respectively. Consequently, at a given pressure (which corresponds to depth), only cells having charge pressures less than that given pressure are compressible, while the remaining cells have their maximum volume. Thus, for the $i^{th}$ cell, in the regions where P is greater than the charge pressure of that cell $P_{Ci}$, the cell volume is proportional to $P_{Ci}V_{Ci}/P$.

For the liquid medium, at a pressure P (or depth), the change in volume ($\Delta V_L$) for the liquid due to the pressure P is $$\Delta V_L = V_o a_L P \tag{1}$$

where $a_L$ is the compressibility coefficient of the liquid and $V_o$ is the volume of the composite platform (i.e. including the base structure and all cells). For the composite platform, at the pressure P, the change in volume $\Delta V_S$ for that platform due to P is $$\Delta V_S = V_o a_S P + \sum_i \left[ V_{Ci} - \frac{V_{Ci}P_{Ci}}{P} \right] \tag{2}$$

where $a_S$ is the compressibility coefficient of the platform at pressures less than any of the charge pressures of the various cells (i.e. with the compensation cells locked out), and $V_{Ci}$ and $P_{Ci}$ are the maximum volume and internal charge pressure, respectively, of the $i^{th}$ compensation cell.

The differential volume $\Delta V_d$ at pressure P for the platform and liquid thus corresponds to $$\Delta V_d = \Delta V_L - \Delta V_s \tag{3}$$

In order to determine the values for the maximum cell volumes and internal charge pressures, in the preferred embodiment, it is initially assumed that the composite platform initially is at point A in FIG. 2, where the platform has a density $\rho_S (= M_S/V_S$, where $M_S$ is the mass of the composite structure) which is greater than the liquid by a positive predetermined tolerance limit ($\Delta\rho_{max+}$), as shown in FIG. 2. Then, the pressure is determined at which the density difference for the composite platform corresponds to a negative predetermined limit ($\Delta\rho_{max-}$). This point is point B in FIG. 2, and corresponds to the charge pressure $P_{C1}$ of the first cell, cell 1. Since the pressures encountered by the cell in progressing from point (depth) A to point (depth) B are all less in magnitude than $P_{Ci}$ (which is the least of the charge pressures for the various cells), the cells are substantially incompressible in this range of depths.

The value for $P_{C1}$ is determined by differentiating $\Delta V_L$ and $\Delta V_S$ with respect to pressure to get $$\frac{d}{dP}(\Delta V_L) = V_o a_L \tag{4}$$

$$\frac{d}{dP}(\Delta V_S) = V_o a_S + V_{c1}P_{C1}/P^2 \tag{5}$$

and setting these results to be equal, and solving for P to identify point C, which denotes the point at which the rate of change of volume with respect to pressure is equal for the liquid and composite platform. Setting equations (4) and (5) to be equal yields:

$$P = \sqrt{V_{C1}P_{C1}/V_o(a_L - a_S)} \tag{6}$$

or $$P = \sqrt{A/B} \tag{7}$$

where $A = V_{C1}P_{C1}$ and $B = V_o(a_L - a_S)$. Substituting equations (6), (7), (1) and (2) into equation (3) yields the differential volume at point B $$\Delta V_d = V_o a_L \sqrt{A/B} - V_o a_S \sqrt{A/B} - V_{C1} + A/\sqrt{A/B} \tag{8}$$

which equals $-BP_{C1}$, the equivalent liquid to platform volume difference at point B. Setting equation (8) equal to $-BP_{C1}$ and solving the resultant quadratic for $V_{C1}$ yields $$V_{C1} = (3 + 2\sqrt{2})V_o(a_L - a_S)P_{C1}. \tag{9}$$

Thus, maximum volume of cell 1, $V_{C1}$, is specified in terms of known quantities $V_o$, $a_L$, $a_S$, and $P_{C1}$.

At pressures (depth) greater than $P_{C1}$, the first cell becomes "compressible", so that as the composite structure becomes further immersed beyond that point (point B in FIG. 2), the difference in density between the liquid and the platform first increases from $\Delta\rho_{min-}$ (at point B in FIG. 2) to $\Delta\rho_{max=}$ (at point C) and then decreases back to $\Delta\rho_{min-}$ (at point D). The pressure at point D, $P_{C2}$ is the internal charge pressure for the second cell, and thus that second cell, and the succeeding cells, are substantially incompressible as the platform passes from pressures $P_{C1}$ to $P_{C2}$ (i.e. in region $R_1$).

To determine the pressure in the range in which only cell 1 is compressible and at which the composite platform is characterized by a density difference relative to the liquid which is again equal to the maximum negative density tolerance, $\Delta\rho_{max-}$, equation (1) becomes $$\Delta V_L = V_o a_L P \tag{10}$$

and equation (2) becomes $$\Delta V_s = V_o a_S P + V_{C1} - V_{C1}P_{C1}/P \tag{11}$$

and equation (3) becomes $$\Delta V_d = V_o a_S P + V_{C1} - V_{C1}P_{C1}/P - V_o a_L P \tag{12}$$

Since, in the region $R_2$, at the pressure where the maximum negative density difference occurs in the region, $V_d$ equals $V_o(a_L - a_S)P_{C1}$ and equation (11) becomes:

$$BP^2 + (BP_{C1} + V_{C1})P + A = 0 \tag{13}$$

where $A = V_{C1}P_{C1}$ and $B = V_o(a_L - a_S)$. The quadratic function represented by equation (12) defines a first pressure (corresponding to $P_{C1}$) and a second, and higher, pressure $$P_{C2} = (3 + 2\sqrt{2})P_{C1} \tag{14}$$

which represents the internal charge pressure for the second cell, cell 2. With this charge pressure, cell 2 is substantially incompressible until the depth of the platform corresponds to pressures greater than $P_{C2}$.

According to equations (4)–(6), in the region $R_2$, $$\frac{d}{dP}(\Delta V_L) = V_o a_L \tag{15}$$

$$\frac{d}{dP}(\Delta V_s) = V_o a_S + V_{C1}P_{C1}/P^2 + V_{C2}P_{C2}/P^2 \tag{16}$$

Setting equations (15) and (16) equal to each other, $$P = \sqrt{(V_{C1}P_{C1} + V_{C2}P_{C2})/V_o(a_L - a_S)} \tag{17}$$

Equation (8) in this region becomes $$\Delta V_d = V_o a_L \sqrt{A'/B} - V_o a_S \sqrt{A'/B} - \tag{18}$$

-continued $$V_{C1} + \frac{A}{\sqrt{A'/B}} - V_{C2} + \frac{C}{\sqrt{A'/B}}$$

where $C = V_{C2}P_{C2}$ and $A' = V_{C1}P_{C1} = V_{C2}P_{C2}$. Setting equation (18) equal to $-BP_{c1}$, and solving the resultant quadratic for $V_{C2}$ yields $$V_{C2} = \left(4 + 2\sqrt{2} + 2\sqrt{2(3 + 2\sqrt{2})}\right) V_o(a_L - a_S)P_{C1} \tag{19}$$

Securing the value for the pressure, $P_{C3}$, at which the change in density next equals $\Delta\rho_{max-}$ (e.g. in a manner similar to that for securing the value for $P_{C2}$), yields $$P_{C3} = \left(5 + 2\sqrt{2} + 2\sqrt{2(3 + 2\sqrt{2})}\right) P_{c1}. \tag{20}$$

This value, $P_{C3}$, corresponds to the charge pressure for cell 3. The above computations may be repeated in a similar manner for cells 3, 4, and 5, and others to provide $P_{Ci}$ and $V_{Ci}$ for the various cells in accordance with the following table:

| i | $P_{Ci}$ | $V_{Ci}$ |
|---|---|---|
| 1 | $P_{C1}$ | $(3 + 2\sqrt{2})BP_{C1}$ |
| 2 | $(3 + 2\sqrt{2})P_{C1}$ | $\left(4 + 2\sqrt{2} + 2\sqrt{2(3 + 2\sqrt{2})}\right) BP_{C1}$ |
| 3 | $\left(5 + 2\sqrt{2} + 2\sqrt{2(3 + 2\sqrt{2})}\right) P_{C1}$ | $\left[2\left(4 + 2\sqrt{2(3 + 2\sqrt{2})}\right)\right] BP_{C1}$ |
| 4 | $\left(11 + 2\sqrt{2} + 4\sqrt{2(3 + 2\sqrt{2})}\right) P_{C1}$ | $\left[2\left(8 + 2\sqrt{2(3 + 2\sqrt{2})}\right)\right] BP_{C1}$ |
| 5 | $\left(21 + 2\sqrt{2} + 6\sqrt{2(3 + 2\sqrt{2})}\right) P_{C1}$ | $\left[2\left(12 + 2\sqrt{2(3 + 2\sqrt{2})}\right)\right] BP_{C1}$ |

where $B = V_o(a_L - a_S)$.

It should be noted that $a_L$ and $a_S$ have been considered constants in the foregoing computations. If either $a_L$ or $a_S$ are non-linear functions of depth pressure, an iterative linearized approximation of the function will generally suffice.

Figure 3:
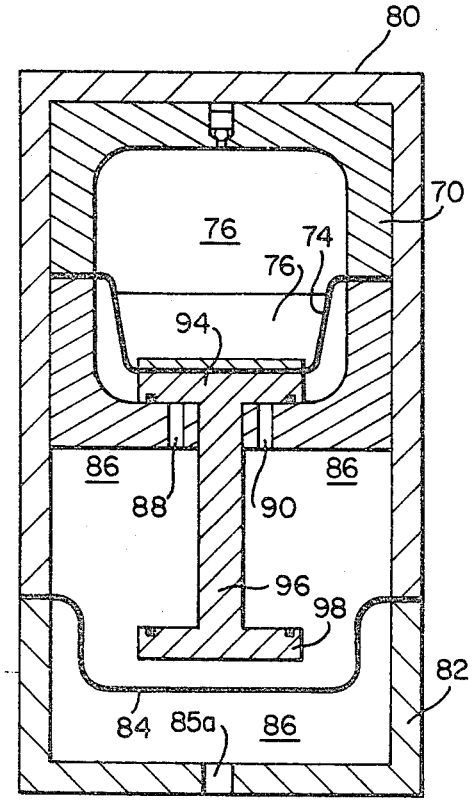
FIGS. 3 and 4 show a compensation cell in accordance with the present invention.
Figure 4:
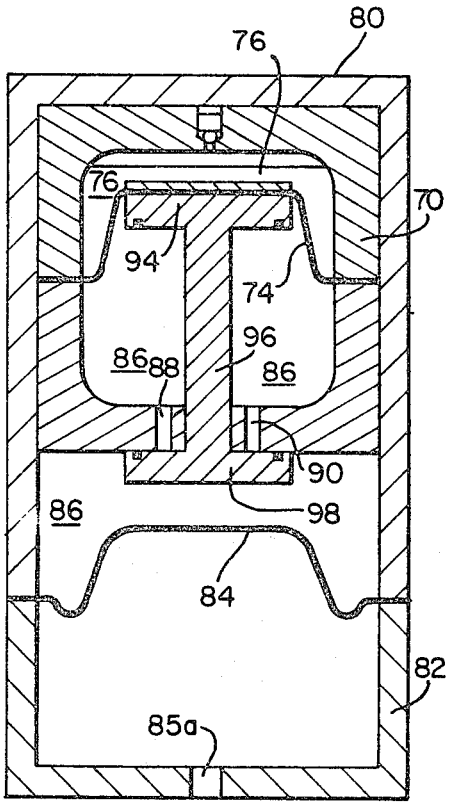

FIGS. 3 and 4 show an alternate form for the ith compressibility compensation cell (or module) where FIG. 3 shows the minimum cell volume and FIG. 4 shows the maximum cell volume. In these figures, an upper pressure housing 70 and lower pressure housing 72 are fitted together about an upper chamber isolation bladder 74 to establish a closed interior region 76. A low gas absorption oil 78 is included within this volume 76 to trim the volume 76 to the desired maximum value.

The upper and lower pressure housings 70 and 72 are positioned within an enclosed assembly formed by upper protective housing 80 and lower protective housing 82. Housings 80 and 82 include an environment isolation bladder 84 positioned between them which provides an enclosed volume within housing 80 and between bladders 74 and 84. This enclosed volume is generally filled with a pressurizing oil 86. The pressurizing oil 86 is coupled by channels 88 and 90 in housing 72. An upper set point valve plate 94 is coupled to the bladder 74 and by way of a valve stem 96 to a lower set point valve plate 98. The interior region 83 between bladder 84 and the inner surface of protective housing 82 is coupled to the environment by way of a port 85*a*.

In operation, when the charge pressure in region 76 exceeds the charge pressure of the region exterior to this cell, then the cell has the form shown in FIG. 3. In this state, the valve plate 94 serves to block the passages 88 and 90, while maintaining volume 76 to be its maximum. When the outside ambient pressure exceeds the pressure in region 76, then the valve plate 94 lifts off its seat, thereby permitting flowthrough of the oil 86 through the channels 88 and 90, as driven by the outside pressure against bladder 84. As the external pressure continues to increase, the volume 76 reaches its minimum, as shown in FIG. 4, where the final set point valve plate rests against housing 72, blocking the channels 88 and 90. In alternate embodiments, the valve plate 98 is not necessary. With this configuration, under extreme non-linear compressibility compensation requirements, the computations are simplified, since the action of the particular compensation cell is only active for a predetermined limited range of pressures. In this configuration, it is particularly advantageous that bladders 74 and 84 are not required to withstand significant pressure differentials at any time during the operation.

Figure 5:
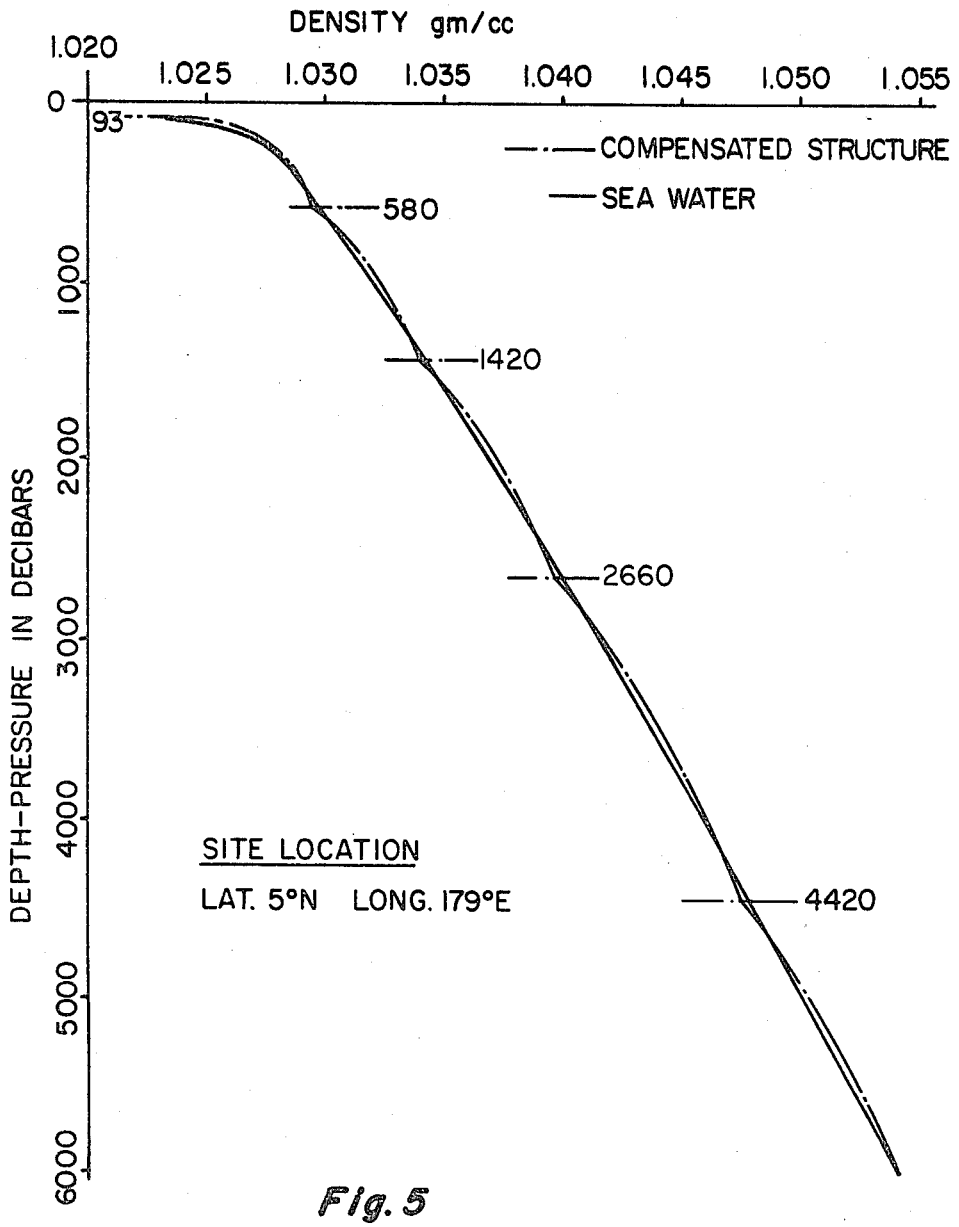
FIG. 5 depicts the density versus pressure characteristics of an exemplary embodiment of the present invention.

FIG. 5 shows the fit one can achieve of a five cell platform (with a 100,000 cubic centimeter composite volume) exposed to an actual ocean density versus depth profile. The ocean density profile shown by the solid line in FIG. 5 is an average profile of eight Latitudes (5 degrees N–3 degrees S) at Longitude 179 degrees E. The platform density is shown by the broken line in FIG. 3. In this example, the allowable mismatch is 0.00055 gm/cc. The base member of the five cell platform is considered to be incompressible. An initial perfect density match is assumed at the 20 decibar depth. At 93 decibars, the allowable mismatch of 0.00055 gm/cc is reached. The gas volume and charge pressure for compensation cell 1 is 0.0075 times the platform volume and 93 decibars charge pressure, respectively. A mismatch of 0.00055 gm/cc occurs next at 580 decibars. Accordingly, the cell 2 charge pressure is 580 decibars. That cell's gas volume is 0.006 times the platform volume. Charge pressures and gas volumes for the additional cells are as follows:

| Cell No. | Cell Charge Pressure in Decibars | Cell Volume as a % of Structure Volume |
|---|---|---|
| 1 | 93 | 0.75 |
| 2 | 580 | 0.6 |
| 3 | 1420 | 0.9 |
| 4 | 2660 | 1.2 |
| 5 | 4420 | 1.5 |
| | Total: | 4.95 |

Figure 6:
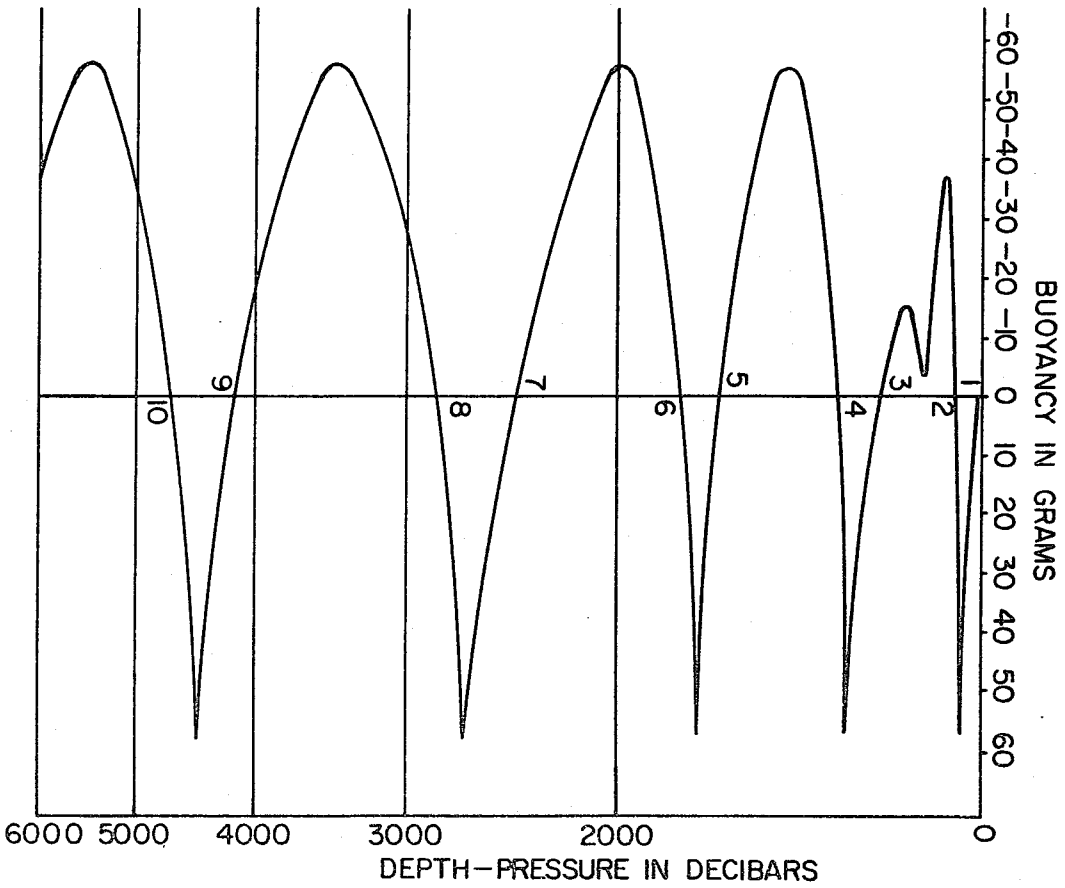
FIG. 6 shows the net buoyancy force as a function of pressure on the embodiment of FIG. 5.

FIG. 6 shows the net buoyancy force on the five cell platform as a function of pressure (or depth).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A passive near-neutral buoyancy platform adapted for submersion in a liquid medium having a compressibility coefficient $a_L$, comprising:

a substantially incompressible base structure and n coupled, variable volume hollow cells coupled thereto, where n is an integer, each cell having a predetermined internal charge pressure and including means responsive to the pressure in said liquid exterior to said cell to monotonically vary the volume of said cell between a predetermined minimum and maximum values, wherein the compressibility of said platform is $a_S$, where $a_S$ is less than $a_L$, wherein the internal charge pressure for the $i^{th}$ cell is $P_{Ci}$ and where the charge pressures for said cells are successively increasing whereby $$P_{Ci}<P_{C2}<\ldots<\ldots P_{Cn}$$

wherein the maximum volume for the $i^{th}$ cell is $V_{Ci}$, and the maximum volume for said platform ($V_o$) equals the sum of the volume of said base structure and $$\sum_i V_{Ci},$$

and wherein $V_{Ci}$ is predetermined so that the density difference between said platform and said liquid equals predetermined negative maximum values when the pressure in said liquid external to said platform equals $P_{Ci}$ and $P_{C(i+1)}$, and that pressure equals a predetermined positive value where the rates of change of density of said platform and said liquid with pressure are equal at a pressure between $P_{Ci}$ and $P_{C(i+1)}$.

2. A platform according to claim 1 adapted for submersion in a region where the density of said liquid varies substantially linearly with pressure, and where said predetermined positive and negative density difference values are substantially constant in said region, wherein $P_{C1}=P_o$ and $$V_{C1} = (3 + 2\sqrt{2})BP_o$$

where B equals $V_o(a_L-a_S)$.

3. A platform according to claim 2 wherein $$P_{C2} = (3 + 2\sqrt{2})P_o$$

and $$V_{C2} = \left(4 + 2\sqrt{2} + 2\sqrt{2(3 + 2\sqrt{2})}\right) BP_{C1}.$$

4. A platform according to claim 3 wherein $$P_{C3} = \left(5 + 2\sqrt{2} + 2\sqrt{2(3 + 2\sqrt{2})}\right) P_{C1}$$

-continued and $$V_{C3} = \left[2\left(4 + 2\sqrt{2(3 + 2\sqrt{2})}\right)\right] BP_{C1}.$$

5. A platform according to claim 4 wherein $$P_{C4} = \left(11 + 2\sqrt{2} + 4\sqrt{2(3 + 2\sqrt{2})}\right) P_{C1}$$

and $$V_{C4} = \left[2\left(8 + 2\sqrt{2(3 + 2\sqrt{2})}\right)\right] BP_{C1}.$$

6. A platform according to claim 5 wherein $$P_{C5} = \left(21 + 2\sqrt{2} + 6\sqrt{2(3 + 2\sqrt{2})}\right) P_{C1}$$

and $$V_{C5} = \left[2\left(12 + 2\sqrt{2(3 + 2\sqrt{2})}\right)\right] BP_{C1}.$$

7. A platform according to claim 1 wherein the volume for the $i^{th}$ cell $V_i$ is equal to $P_{Ci}V_{Ci}/P$ at pressures greater than $P_{Ci}$ and is equal to $V_{Ci}$ otherwise.

8. A platform according to claim 1 wherein said $i^{th}$ cell includes an elastically collapsible metal bellows assembly enclosing a region having a gas therein at a pressure $P_{Ci}$, and further includes means for limiting expansion of said bellows assembly whereby the maximum volume of said region is $V_{Ci}$.

9. A platform according to claim 8 wherein said limiting means includes a base member underlying said bellows assembly and an associated lip member coupled thereto and including means for interferingly engaging said bellows assembly to prevent further expansion when said region becomes equal to $V_{Ci}$.

* * * * *

UNITED STATES PATENT AND TRADEMARK OFFICE

CERTIFICATE OF CORRECTION

PATENT NO. : 4,364,325

DATED : December 21, 1982

INVENTOR(S) : Philip N. Bowditch

It is certified that error appears in the above-identified patent and that said Letters Patent are hereby corrected as shown below:

Column 6, line 60, "$\Delta$Pmax=" should be --$\Delta$Pmax+--;

Column 8, line 6, "$A'=V_{C1}P_{C1}=V_{C2}P_{C2}$" should be

--$A'=V_{C1}P_{C1}+V_{C2}P_{C2}$--.

Signed and Sealed this

*Nineteenth* Day of *February 1985*

[SEAL]

*Attest:*

DONALD J. QUIGG

*Attesting Officer* *Acting Commissioner of Patents and Trademarks*